US007010489B1

(12) United States Patent
Lewis et al.

(10) Patent No.: US 7,010,489 B1
(45) Date of Patent: Mar. 7, 2006

(54) METHOD FOR GUIDING TEXT-TO-SPEECH OUTPUT TIMING USING SPEECH RECOGNITION MARKERS

(75) Inventors: James R. Lewis, Delray Beach, FL (US); Kerry A. Ortega, Raleigh, NC (US); Huifang Wang, Boynton Beach, FL (US)

(73) Assignee: International Business Mahcines Corporation, Armonk, NY (US)

( * ) Notice: Subject to any disclaimer, the term of this patent is extended or adjusted under 35 U.S.C. 154(b) by 0 days.

(21) Appl. No.: 09/521,593

(22) Filed: Mar. 9, 2000

(51) Int. Cl.
*G10L 13/08* (2006.01)

(52) U.S. Cl. ..... 704/260; 704/258

(58) Field of Classification Search ..... 704/270, 704/260, 258, 256, 257, 255
See application file for complete search history.

(56) References Cited

U.S. PATENT DOCUMENTS

| | | | | |
|---|---|---|---|---|
| 5,652,828 | A * | 7/1997 | Silverman | 704/258 |
| 5,682,501 | A * | 10/1997 | Sharman | 704/256 |
| 5,913,193 | A * | 6/1999 | Huang et al. | 704/256 |
| 5,920,838 | A * | 7/1999 | Mostow et al. | 704/251 |
| 6,003,005 | A * | 12/1999 | Hirschberg | 704/260 |
| 6,161,087 | A * | 12/2000 | Wightman et al. | 704/215 |
| 6,173,262 | B1 * | 1/2001 | Hirschberg | 704/260 |
| 6,631,346 | B1 * | 10/2003 | Karaorman et al. | 704/9 |

* cited by examiner

*Primary Examiner*—Angela Armstrong
(74) *Attorney, Agent, or Firm*—Akerman Senterfitt

(57) ABSTRACT

A method for guiding text-to-speech output timing with speech recognition markers can include the following steps. First, tokens can be retrieved in a TTS system. The tokens can include words, phrase markers, punctuation marks and meta-tags. Second, phrase markers can be identified among the retrieved tokens. Third, words can be identified among the retrieved tokens. Fourth, the TTS system can TTS play back the identified words. Finally, during the TTS playback of the words, the TTS system can pause in response to the identification of the phrase markers.

20 Claims, 3 Drawing Sheets

METHOD FOR GUIDING TEXT-TO-SPEECH OUTPUT TIMING USING SPEECH RECOGNITION MARKERS

CROSS REFERENCE TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

1. Technical Field

This invention relates to the field of text-to-speech synthesis and more particularly to a method for guiding text-to-speech output timing using speech recognition markers.

2. Description of the Related Art

The present invention relates to a text-to-speech [TTS] system for converting input text into an output acoustic signal imitating natural speech. TTS systems create artificial speech sounds directly from text input. Conventional TTS systems generally operate in a sequential manner, dividing the input text into relatively large segments such as sentences using an external process. Subsequently, each segment is sequentially processed until the required acoustic output can be created.

Initially, input text can be submitted to the TTS system. Subsequently, the TTS system can convert the input text to an acoustic waveform recognizable as speech corresponding to the input text. A typical TTS system can include two main components: a linguistic processor and an acoustic processor. The linguisitic processor can generate lists of speech segments derived from the text input, together with control information, for example phonemes, plus duration and pitch values. Subsequently, during the conversion processes the input text can pass across an interface from the linguistic processor to the acoustic processor. The acoustic processor produces the sounds corresponding to the specified segments. Moreover, the acoustic processor handles the boundaries between each speech segment to produce natural sounding speech.

Unfortunately, to date most commercial systems for automated synthesis remain too unnatural and machine-like for all but the simplest and shortest texts. Those systems have been described as sounding monotonous, boring, mechanical, harsh, disdainful, peremptory, fuzzy, muffled, choppy, and unclear. Synthesized isolated words presented in context are relatively easy to recognize, but when strung together into longer passages of connected speech, for instance phrases or sentences, then it becomes much more difficult to follow the meaning. Notably, studies have shown that the task is unpleasant and the effort is fatiguing. In consequence, more widespread adoption of TTS technology has been prevented by the perceived robotic quality of some voices and poor intelligibility of intonation-related cues.

In general, the robotic feel of the TTS system arises from inaccurate or inappropriate modeling of speech segments defined in TTS production rules. To overcome such deficiencies, considerable attention has been paid to improving the production rules by modeling grammatical information derived from a series of connected words. In the prior art, typical TTS production rules are designed to cope with "unrestricted text". Synthesis algorithms for unrestricted text typically assign prosodic features (prosody) on the basis of syntax, lexical properties, and word classes. Prosody primarily involves pitch, duration, loudness, voice quality, tempo and rhythm. In addition, prosody modulates every known aspect of articulation. Specifically, prosodic features can be derived from the organization imposed onto a string of words when they are uttered as connected speech.

TTS system developers have struggled with the problem of prosodic phrasing, or the "chunking" of a long sentence into several sub-phrases, each of which can be said to stand alone as an intonational unit. If punctuation is used liberally so that there are relatively few words between the commas, semicolons or periods, then TTS production rules can propose a reasonable guess at an appropriate phrasing by subdividing the sentence at each punctuation mark. Notwithstanding, a problem remains where there exists long stretches of words having no punctuation. In that case, the TTS production rules must strategically place appropriate pauses in the playback sequence.

One prior art approach includes the generation and storage of a list of words, typically function words, that are likely indicators of good break positions. Yet, in some cases a particular function word may coincide with a plausible phrase break whereas in other cases that same function may coincide with a particularly poor phrase break position. As such, a known improvement includes the incorporation of an accurate syntactic parser for generating syntactic groupings and the subsequent derivation of the prosodic phrasing from the syntactic groupings. Still, prosodic phrases usually do not coincide exactly with major syntactic phrases.

Alternatively, the TTS system developer can train a decision tree on transcribed speech data. Specifically, the transcribed speech data can include a dependent variable linked to the human prosodic phrase boundary decision. Moreover, the transcribed speech data can include independent variables linked to the text directly, including part of speech sequence around the boundary, the location of the edges of long noun phrases, and the distance of the boundary from the edges of the sentence. Nevertheless, TTS output generated by production rules alone cannot produce proper pausing behavior. Present methods of TTS generation wholly lack naturalized timing in consequence of the TTS system's dependence on production rules. Present TTS systems do not incorporate the use of timing data embedded in the dictated text with standard production rules in order to generate more naturalized playback timing. Thus, a need exists for an algorithm which can produce a more natural playback though the use of speech-recognition markers embedded in the dictated text.

SUMMARY OF THE INVENTION

A method for guiding text-to-speech output timing using speech recognition markers in accordance with the inventive arrangement can integrate phrase markers embedded in dictated text with text-to-speech [TTS] playback technology, the integration resulting in a more natural and realistic playback. Thus, the inventive arrangements provide a method and system for realistically playing back synthesized isolated words strung together into longer passages of connected speech, for instance phrases or sentences. The method of the invention can include the following steps. First, tokens can be retrieved in a TTS system. The tokens can include words, phrase markers, punctuation marks and meta-tags. Second, phrase markers can be identified among the retrieved tokens. Third, words can be identified among the retrieved tokens. Fourth, the TTS system can TTS play back the identified words. Finally, during the TTS playback of the words, the TTS system can pause in response to the identification of the phrase markers.

In one aspect of the invention, the method of the invention can further include the steps of: identifying punctuation marks among the retrieved tokens; and, pausing in response to the identification of the punctuation marks. Also, the method of the invention can further include the steps of: identifying meta-tags among the retrieved tokens; and, pausing in response to the identification of the meta-tags. In the preferred embodiment, the TTS playing back step comprises the step of TTS playing back a token using TTS production rules. The inventive method can further comprise the steps of delaying TTS playback for a period of time corresponding to a programmable upper limit on pause length; and, subsequent to the period of time, resuming playback.

In another aspect of the inventive method, the pausing step can include the steps of: identifying pause duration data embedded in the phrase marker; and, pausing for a period of time corresponding to the pause duration data. In an alternative embodiment, the pausing step comprises the step of pausing for a programmatically determined length of time. Moreover, the step of pausing in response to the identification of a punctuation mark can include classifying the identified punctuation mark into a punctuation class; and, pausing for a programmatically determined length of time corresponding to the punctuation class. Notably, the punctuation class can be selected from the group consisting of sentence internal markers and sentence final markers.

In yet another aspect of the present invention, the pausing step comprises the steps of: retrieving a user playback preference. If the retrieved user playback preference indicates a user playback preference for realistic playback, the TTS system can pause for a period of time corresponding to pause duration data stored with the phrase marker. Otherwise, if the retrieved user playback preference indicates a user preference for streamlined playback, the TTS system can pause for a programmatically determined length of time. In particular, the step of pausing for a programmatically determined length of time can comprise the step of pausing for a period of time corresponding to a punctuation class selected from the group consisting of: sentence internal markers and sentence final markers.

BRIEF DESCRIPTION OF THE DRAWINGS

There are presently shown in the drawings embodiments which are presently preferred, it being understood, however, that the invention is not limited to the precise arrangements and instrumentalities shown.

DETAILED DESCRIPTION OF THE INVENTION

In a preferred embodiment of the present invention, a method for guiding text-to-speech [TTS] output timing using speech recognition markers can improve the naturalness of playback timing for TTS playback of dictated text. A TTS system in accordance with the inventive arrangements can perform TTS playback in a manner in which the TTS system more accurately imitates the timing of dictated text. Consequently, a TTS system in accordance with the present invention can can exhibit more appropriate pausing behavior during TTS playback than TTS playback generated by TTS playback production rules alone.

A TTS system in accordance with the inventive arrangements can utilize timing information previously stored in data corresponding to the dictated speech during a speech dictation session. The timing information, specifically, "phrase markers", can be inserted by a speech dictation system during speech dictation. The phrase markers can support ancillary speech dictation features. An example of an ancillary speech dictation feature can include the "SCRATCH-THAT" command, a command for deleting the previously dictated phrase. Still, the invention is not limited in this regard. Rather, the phrase markers can be inserted by the speech dictation system to support any ancillary feature, regardless of its intended function. Significantly, the phrase markers can be inserted when, during a speech dictation session, a speaker pauses at a syntactically appropriate place. Thus, by detecting phrase markers in dictated text, a TTS system in accordance with the inventive arrangements can identify an appropriate position in the dictated text to insert a pause during TTS playback. In identifying phrase markers and pausing responsive thereto, the TTS system performing TTS playback of the speech dictated text can more accurately imitate the playback timing of the originally dictated text.

Figure 1:
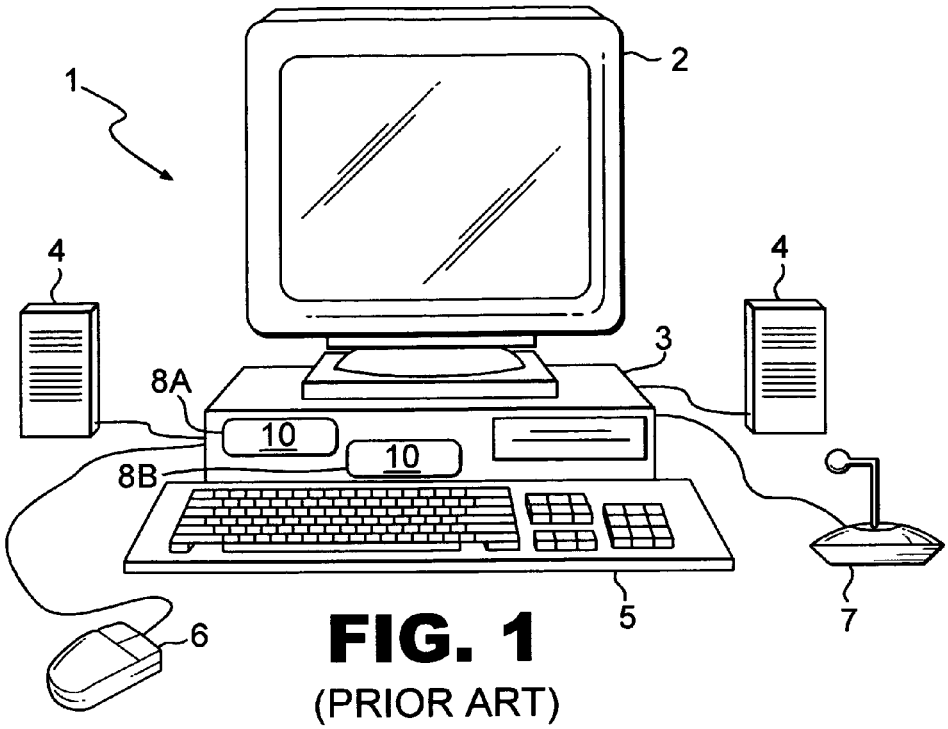
FIG. 1 (PRIOR ART)
FIG. 1 is a pictorial representation of computer system suitable for performing the inventive method.

FIG. 1 depicts a typical computer system 1 for use in conjunction with the present invention. The system preferably comprises a computer 3 including a central processing unit (CPU), fixed disk 8A, and internal memory device 8B. The system also includes a microphone 7 operatively connected to the computer system through suitable interface circuitry or "sound board" (not shown), a keyboard 5, and at least one user interface display unit 2 such as a video data terminal (VDT) operatively connected thereto. The CPU can comprise any suitable microprocessor or other electronic processing unit, as is well known to those skilled in the art. An example of such a CPU would include the Pentium or Pentium II brand microprocessor available from Intel Corporation, or any similar microprocessor. Speakers 4, as well as an interface device, such as mouse 6, can also be provided with the system, but are not necessary for operation of the invention as described herein. The various hardware requirements for the computer system as described herein can generally be satisfied by any one of many commercially available high speed multimedia personal computers offered by manufacturers such as International Business Machines (IBM).

Figure 2:
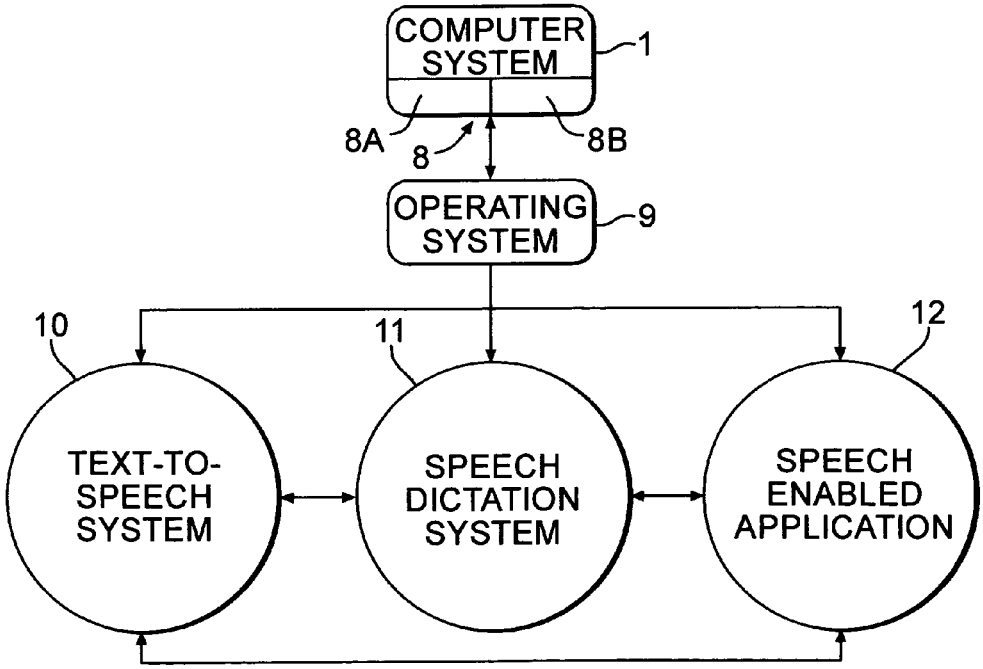
FIG. 2 is a block diagram showing a typical high level architecture for the computer system in FIG. 1.

FIG. 2 illustrates a presently preferred architecture for a TTS system in computer 1. As shown in FIG. 2, the system can include an operating system 9, a TTS system 10 in accordance with the inventive arrangements, and a speech dictation system 11. A speech enabled application 12 can also be provided. In FIG. 2, the TTS system 10, speech dictation system 11, and the speech enabled application 12 are shown as separate application programs. It should be noted, however, that the invention is not limited in this regard, and these various applications could, of course, be implemented as a single, more complex applications program. As shown in FIG. 2, computer system 1 includes one or more computer memory devices 8, preferably an electronic random access memory 8B and a bulk data storage medium, such as a fixed disk drive 8A. Accordingly, each of the operating system 9, the TTS system 10, the speech dictation system 11 and the speech enabled application 12 can be stored in fixed storage 8A and loaded for execution in random access memory 8B.

In a presently preferred embodiment described herein, operating system 9 is one of the Windows family of operating systems, such as Windows NT, Windows 95 or Windows 98 which are available from Microsoft Corporation of Redmond, Wash. However, the system is not limited in this regard, and the invention can also be used with any other type of computer operating system. The system as disclosed herein can be implemented by a computer programmer, using commercially available development tools for the operating systems described above.

In the preferred embodiment, following a speech dictation session, the speaker can proofread the speech dictated text for content, grammar, spelling and recognition errors. To assist the speaker during proofreading, TTS system 10 can playback the recognized text by converting the displayed text to a digitized audio signal, passing the audio signal to the operating system 9 for processing by computer 1, and, using conventional computer audio circuitry, converting the digitized audio signal to sound. Having converted the digitized audio signal to sound, computer system 1 can pass the converted sound to speakers 4 connected to computer system 1. Thus, the speaker can compare the TTS playback with the speech dictated text to further identify contextual, grammatical, spelling and recognition errors.

Figure 3:
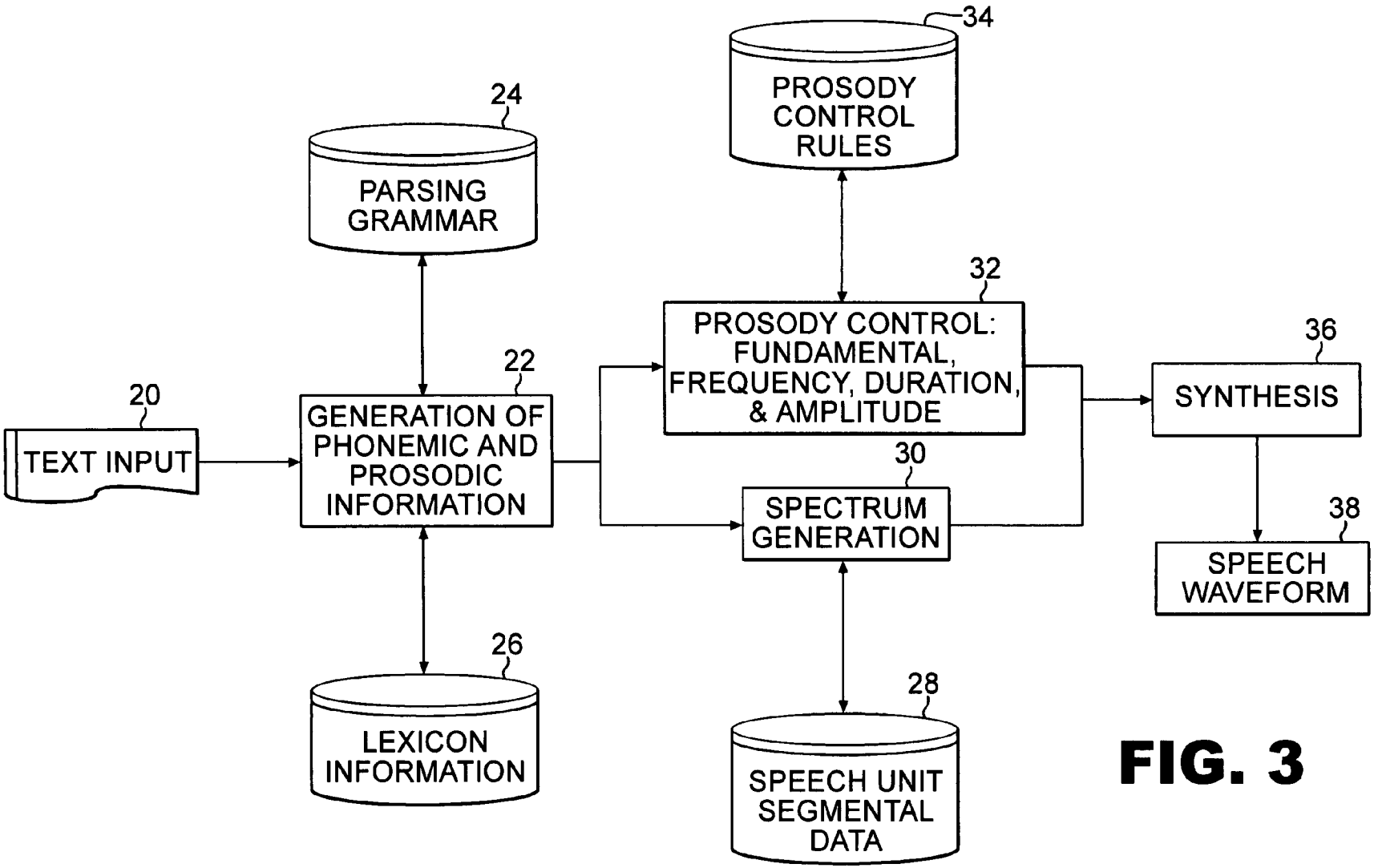
FIG. 3 is a block diagram of a typical text-to-speech system suitable for performing the inventive method.

FIG. 3 is a block diagram of a typical TTS system 10 suitable for performing the inventive method. In a typical TTS system 10, text input 20 is passed to a text segmenter 22 whose function is the generation of phonemic and prosodic information 22. Typically, text segmentation can be a straightforward process inasmuch as the TTS system 10 can assume that word boundaries coincide with white-space or punctuation in the text input 20. In addition, text segmenter 22 can identify word boundaries with the assistance of a parsing grammar 24. Moreover, the addition of lexicon information 26 whose function is the enumeration of word forms of a language is preferable for assisting the text segmenter 22 in word segmentation. Finally, despite lexicon information 26, either a heuristic approach or a statistical approach can be employed to determine an optimum segmentation. A heuristic approach can include a greedy algorithm for finding the longest word at any point. In contrast, a statistical approach can include an algorithm for finding the most probable sequence of words according to a statistical model.

Subsequent the text segmentation by the text segmenter 22, the TTS System 10 can subject the text input 20, to two stages prior to a synthesis step. The first stage can include a decoding process which can produce a reconstructed audio waveform from the text input 20. The second stage can include the imposition of prosodic characteristics onto the reconstructed waveform. To produce the reconstructed waveform, a spectrum generation module 30, using speech unit segmental data 28, can compute a fundamental frequency contour representing an appropriate audio intonation. One method of computing a reconstructed waveform can include adding three types of time-dependent curves: a phrase curve, which depends on the type of phrase, e.g., declarative or interrogative; accent curves, one for each accent group; and perturbation curves, which capture the effects of obstruents on pitch in the post-consonantal vowel.

Concurrently, the prosody control module 32 can compute a pronunciation or set of possible pronunciations for the words, given the orthographic representation of those words. Commonly, letter-to-sound rules can map sequences of morphemes into sequences of phonemes. Furthermore, using prosody control rules 34, the prosody control module 32 can assign diacritic information, such as frequency, duration and amplitude, to each phonemic segment produced by the text segmenter 22. Given the string of segments to be synthesized, each segment can be tagged with a feature vector containing information on a variety of factors, such as segment identity, syllable stress, accent status, segmental context, or position in a phrase. Subsequently, a synthesizer 36 can impose the newly formed prosodic characteristics upon the reconstructed waveform forming speech waveform 38.

Figure 4:
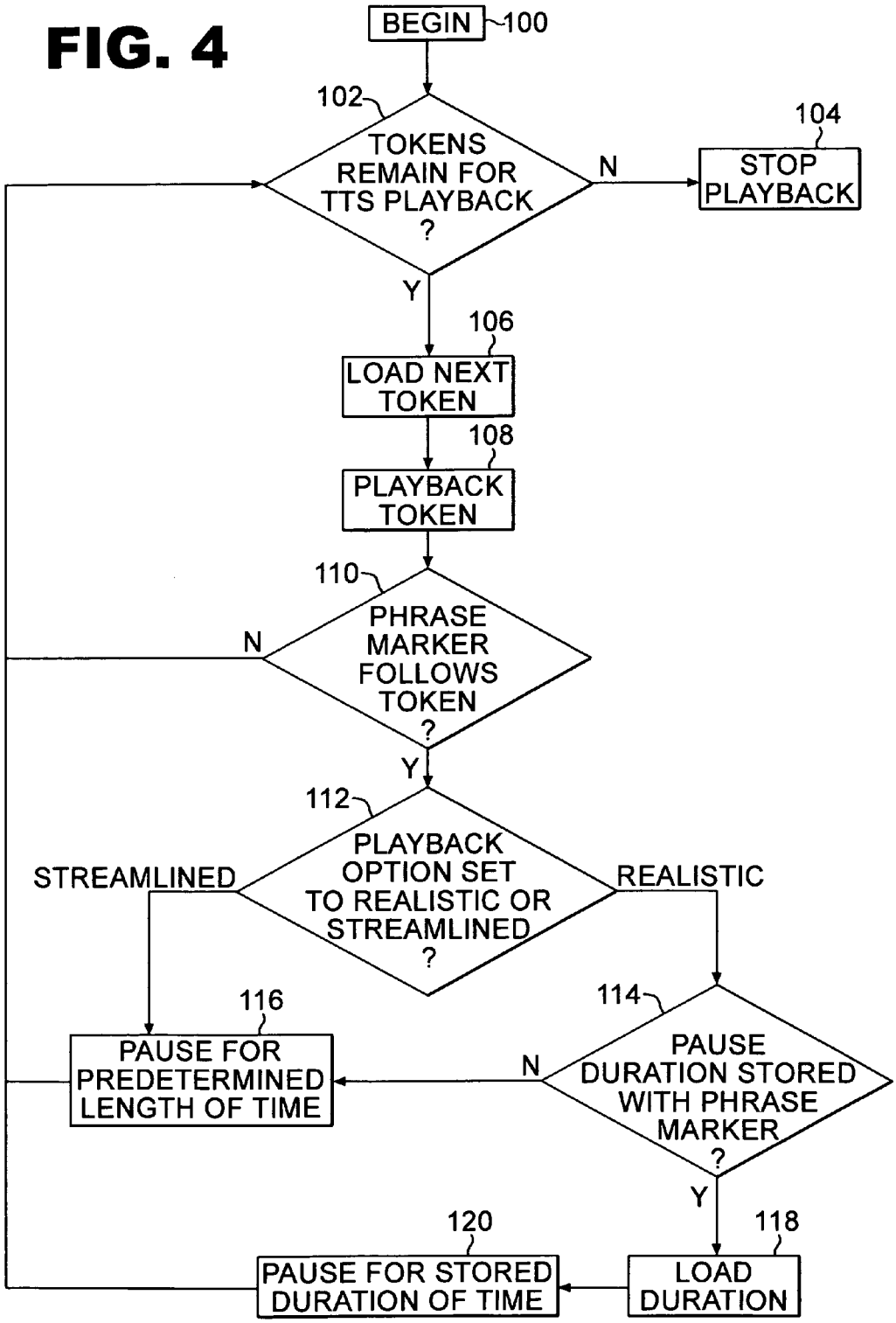
FIG. 4 is a flow chart illustrating the inventive method.

FIG. 4 is a flow chart illustrating a method for guiding TTS output using speech recognition markers. In synthesizing a long sentence, it is desirable for prosody control 32 to subdivide the long sentence into several sub-sentence phrases, each of which can be said to stand alone as an intonational unit. If punctuation is used liberally so that there are relatively few words between commas, semicolons or periods, than prosody control 32 can interject a pause during prosodic phrasing at each punctuation mark. However, if the text input 20 includes long stretches of segmented words without corresponding punctuation, further analysis can be necessary.

In FIG. 4, the inventive method addresses the needed further analysis. The method in accordance with the inventive arrangements begins in step 100. The method can be applied to text input 20 which can contain a series of tokens. During TTS playback, the TTS system can load and process each token in the text input 20. As used in describing the inventive process, a token can refer to a word, punctuation mark or any other symbol or meta-tag that the TTS system 10 interprets during playback. In processing text input 20, in decision step 102 the method of the invention proceeds only if a token remains to be processed by the TTS system 10. In step 106, the next unprocessed token can be loaded for processing by the TTS system 10. Accordingly, in step 108, the TTS system 10 can play back the token, resulting an audible representation of the token emanating from speakers 4.

Significantly, in decision step 110, the TTS system 10 can detect the presence of a phrase marker following a processed token. In the preferred embodiment, phrase markers can be inserted during speech dictation by speech dictation system 11. Phrase markers can be inserted in support of an ancilliary feature of the speech dictation system 11, for example a SCRATCH-THAT command for deleting the previously dictated phrase. Notwithstanding, one skilled in the art will recognize that any text-processing system, be it a speech dictation system, or a post-dictation processor for processing dictated speech subsequent to speech dictation, can insert phrase markers for a variety of purposes, not necessarily linked to the dictation process. For example, a tele-prompter system can insert a phrase marker to visually indicate to a speaker when to pause in reading back visual prompts.

If the TTS system 10 does not detect a phrase marker following the processed token, the TTS system returns to decision step 102 where the process can repeat if additional tokens remain to be processed. In contrast, if the TTS system 10 detects a phrase marker in decision step 110, in decision step 112, the TTS system can further determine if the user has chosen a TTS system playback option to perform realistic playback, or alternatively, a streamlined playback. If the user has chosen to perform a streamlined playback, in step 116 the TTS system 10 can pause for a predetermined length of time before returning to decision step 102 where the process can repeat if additional tokens remain to be processed.

The predetermined length of time can be linked to both sentence internal markers, like commas and semicolons, and final markers, like periods, exclamation points and question marks. For example, for sentence internal markers, in response to a comma, the user could program the system to pause for seventy-five (75) percent of a default pausing period. Similar proportional pausing periods can be pre-programmed for sentence final markers, for example a period or exclamation point. In the preferred embodiment, tags or punctuation that would otherwise trigger pauses take precedence over phrase markers. In any event, both the predetermined length of time, as well as the proportional pausing periods corresponding to sentence internal and final markers, can be chosen by the user and stored in a user preferences database.

Alternatively, if in decision step 112, the user has chosen to perform a realistic playback, in step 114, the TTS system 10 can identify in the phrase marker a corresponding pause duration. If no duration has been stored with the phrase marker, in step 116 the TTS system 10 can pause for a predetermined length of time before returning to decision step 102 where the process can repeat if additional tokens remain to be processed. However, if a duration has been stored with the phrase marker, in step 118 the duration can be loaded and in step 120, the TTS system 10 can pause for the specified duration. Moreover, the TTS system 10 can ignore tags or punctuation in the text that would otherwise trigger pauses. One skilled in the art will recognize, however, that the inventive method is not limited in this regard. In particular, in an alternative embodiment a user could pre-program an upper limit on pause lengths, even for realistic feedback. Thus, a 2 second upper limit would permit more realistic playback without forcing the user to wait through very long pauses. Subsequently, the process can return to decision step 102 where the process can repeat if additional tokens remain to be processed. When no tokens remain to be processed, in step 104, playback can terminate.

Thus, the inventive method integrates existing timing information stored in phrase markers in dictated text, with TTS playback technology resulting in more natural and realistic playback. In consequence of the inventive method, synthesized isolated words strung together into longer passages of connected speech, for instance phrases or sentences, are more easily recognizable to the listener. As a result, the inventive method can reduce the perceived robotic quality of some voices and poor intelligibility of intonation-related cues and can provide for more widespread adoption of TTS technology.

What is claimed is:

1. A method for guiding text-to-speech output timing with speech recognition markers comprising the steps of:

retrieving tokens in a text-to-speech (TTS) system, said tokens comprising words, phrase markers, punctuation marks and meta-tags;

identifying said phrase markers among said retrieved tokens, said phrase markers specifying timing information corresponding to previously dictated speech;

identifying said words among said retrieved tokens;

playing back said identified words using said TTS system; and, pausing said TTS playback in response to said identification of said phrase markers in accordance with said specified timing information.

2. The method according to claim 1, further comprising the steps of:

identifying said punctuation marks among said retrieved tokens; and, pausing in response to said identification of said punctuation marks.

3. The method according to claim 2, wherein said step of pausing in response to said identification of a punctuation mark comprises the steps of:

classifying said identified punctuation mark into a punctuation class;

pausing for a programmatically determined length of time corresponding to said punctuation class.

4. The method according to claim 3, wherein said punctuation class is a class selected from the group consisting of sentence internal markers and sentence final markers.

5. The method according to claim 1, wherein said pausing step comprises the steps of:

identifying pause duration data embedded in said phrase marker; and, pausing for a period of time corresponding to said pause duration data.

6. The method according to claim 1, wherein said pausing step comprises the step of pausing for a programmatically determined length of time.

7. The method according to claim 1, wherein said pausing step comprises the steps of:

retrieving a user playback preference;

if said retrieved user playback preference indicates a user preference for realistic playback, pausing for a period of time corresponding to pause duration data stored with said phrase marker; and, if said retrieved user playback preference indicates a user preference for streamlined playback, pausing for a programmatically determined length of time.

8. The method according to claim 1, further comprising the steps of:

identifying said meta-tags among said retrieved tokens; and, pausing in response to said identification of said meta-tags.

9. The method according to claim 1, wherein said TTS playing back step comprises the step of TTS playing back said tokens using TTS production rules.

10. The method according to claim 1, wherein said pausing step comprises the steps of:

delaying TTS playback for a period of time corresponding to a programmable upper limit on pause length; and, resuming TTS playback subsequent to said period of time.

11. A machine readable storage, having stored thereon a computer program having a plurality of code sections executable by a machine for causing the machine to perform the steps of:

retrieving tokens in a text-to-speech (TTS) system, said tokens comprising words, phrase markers, punctuation marks and meta-tags;

identifying said phrase markers among said retrieved tokens, said phrase markers specifying timing information corresponding to previously dictated speech;

identifying said words among said retrieved tokens;

playing back said identified words using said TTS system; and, pausing said TTS playback in response to said identification of said phrase markers in accordance with said specified timing information.

12. The machine readable storage according to claim 11, further comprising the steps of:

identifying said punctuation marks among said retrieved tokens; and, pausing in response to said identification of said punctuation marks.

13. The machine readable storage according to claim 12, wherein said step of pausing in response to said identification of a punctuation mark comprises the steps of:

classifying said identified punctuation mark into a punctuation class;

pausing for a programmatically determined length of time corresponding to said punctuation class.

14. The machine readable storage according to claim 13, wherein said punctuation class is a class selected from the group consisting of sentence internal markers and sentence final markers.

15. The machine readable storage according to claim 11, wherein said pausing step comprises the steps of:

identifying pause duration data embedded in said phrase marker; and, pausing for a period of time corresponding to said pause duration data.

16. The machine readable storage according to claim 11, wherein said pausing step comprises the step of pausing for a programmatically determined length of time.

17. The machine readable storage according to claim 11, wherein said pausing step comprises the steps of:

retrieving a user playback preference;

if said retrieved user playback preference indicates a user preference for realistic playback, pausing for a period of time corresponding to pause duration data stored with said phrase marker; and, if said retrieved user playback preference indicates a user preference for streamlined playback, pausing for a programmatically determined length of time.

18. The machine readable storage according to claim 11, further comprising the steps of:

identifying said meta-tags among said retrieved tokens; and, pausing in response to said identification of said meta-tags.

19. The machine readable storage according to claim 11, wherein said TTS playing back step comprises the step of TTS playing back said tokens using TTS production rules.

20. The machine readable storage according to claim 11, wherein said pausing step comprises the steps of:

delaying TTS playback for a period of time corresponding to a programmable upper limit on pause length; and, resuming TTS playback subsequent to said period of time.

* * * * *